US009434904B2

(12) United States Patent
Deschampt et al.

(10) Patent No.: US 9,434,904 B2
(45) Date of Patent: Sep. 6, 2016

(54) LUBRICANT FOR FORGING IN THE FORM OF A POWDER OR A COMPACTED POWDER

(71) Applicant: CONDAT S.A., Chasse sur Rhone (FR)

(72) Inventors: Frédéric Deschampt, Saint Genis Laval (FR); Bernadette Gregot, Oullins (FR)

(73) Assignee: CONDAT S.A., Chasse sur Rhone (FR)

( * ) Notice: Subject to any disclaimer, the term of this patent is extended or adjusted under 35 U.S.C. 154(b) by 168 days.

(21) Appl. No.: 14/364,543

(22) PCT Filed: Dec. 19, 2012

(86) PCT No.: PCT/FR2012/052992

§ 371 (c)(1),
(2) Date: Jun. 11, 2014

(87) PCT Pub. No.: WO2013/104843

PCT Pub. Date: Jul. 18, 2013

(65) Prior Publication Data

US 2014/0349900 A1 Nov. 27, 2014

(30) Foreign Application Priority Data

Dec. 20, 2011 (FR) ..... 11 61976

(51) Int. Cl.

| | |
|---|---|
| ***C10M 141/02*** | (2006.01) |
| ***C10M 111/02*** | (2006.01) |
| ***C10M 173/02*** | (2006.01) |
| *C10M 103/06* | (2006.01) |
| *C10M 105/26* | (2006.01) |

(52) U.S. Cl.

CPC ..... *C10M 111/02* (2013.01); *C10M 141/02* (2013.01); *C10M 173/02* (2013.01); *C10M 103/06* (2013.01); *C10M 105/26* (2013.01); *C10M 2201/02* (2013.01); *C10M 2201/062* (2013.01); *C10M 2201/0613* (2013.01); *C10M 2207/123* (2013.01); *C10M 2207/127* (2013.01); *C10M 2207/1233* (2013.01); *C10M 2207/142* (2013.01); *C10N 2210/01* (2013.01); *C10N 2240/402* (2013.01); *C10N 2250/08* (2013.01); *C10N 2270/02* (2013.01)

(58) Field of Classification Search

CPC ..... C10M 111/02; C10M 141/02; C10M 173/02; C10M 103/06; C10M 105/26; C10M 2201/02; C10M 2201/0613; C10M 2201/062; C10M 2207/123; C10M 2207/1233; C10M 2207/127; C10M 2207/142; C10N 2210/01; C10N 2240/402; C10N 2250/08; C10N 2270/02

See application file for complete search history.

(56) References Cited

U.S. PATENT DOCUMENTS

| | | | |
|---|---|---|---|
| 5,035,859 A | 7/1991 | Gu et al. | |
| 2011/0059882 A1 | 3/2011 | Smith et al. | |

FOREIGN PATENT DOCUMENTS

| | | | | |
|---|---|---|---|---|
| DE | 30 01 102 A1 | | 7/1981 | |
| EP | 0 078 361 A1 | | 5/1983 | |
| FR | 2 062 915 | | 7/1971 | |
| GB | 1 165 098 | | 9/1969 | |
| GB | 1165098 A | * | 9/1969 | ..... A61K 9/0007 |
| GB | 1 121 038 | | 2/1971 | |
| WO | 2010/017361 A1 | | 2/2010 | |

OTHER PUBLICATIONS

International Search Report issued in International Application No. PCT/FR2012/052992 mailed Apr. 22, 2013.

Written Opinion of the International Searching Authority issued in International Application No. PCT/FR2012/052992 mailed Apr. 22, 2013.

Aug. 27, 2015 Office Action issued in European Patent Application No. 12 816 730.1.

* cited by examiner

*Primary Examiner* — Taiwo Oladapo
(74) *Attorney, Agent, or Firm* — Oliff PLC

(57) ABSTRACT

The present invention relates to a lubricating composition for forging in the form of a powder or a compacted powder including: one or more dicarboxylic acid(s) chosen among adipic acid, phthalic acid, isophthalic acid, terephthalic acid, sebacic acid, succinic acid and suberic acid; and one or more base(s) chosen among sodium carbonate, sodium bicarbonate, potassium carbonate and potassium bicarbonate, the dicarboxylic acid(s)/base(s) molar ratio ranging between 0.8 and 1.2.

9 Claims, No Drawings

LUBRICANT FOR FORGING IN THE FORM OF A POWDER OR A COMPACTED POWDER

RELATED APPLICATION

This application is a national stage entry of PCT/FR2012/052992, filed Dec. 19, 2012 which claims priority from French Patent Application No. 11/61976, filed Dec. 20, 2011, which are incorporated by reference in their entirety.

The present invention relates to a lubricating composition for forging in the form of a powder or a compacted powder.

The shaping of metal parts by applying powerful compression and traction forces is common in the industry. It is generally referred to as embossing or forging.

Forging allows manufacturing parts of various shapes made from metals or alloys by plastic deformation at temperatures able to range from room temperature up to several hundreds of degrees and even more. The techniques used can be free forging, stamping, cold heading, die-stamping, electro-fulling, extrusion or ring rolling. Forged parts may be made from steel, brass, titanium, inconel, bronze, aluminum as well as their different alloys.

The shape of the finished part is determined by the shape of the recesses of the metal die(s) used. With dies with open cavity, as in the case of drop forging, the blank is compressed between the die and the ram. With dies with closed cavity, as in die-stamping, the blank is compressed between the lower die and an upper die fixed on a moving portion.

During forging operations, the compressive force is applied to preformed blocks or metal blanks, generally taken to high or very high temperature, by means of one or more separate passe(s).

In order to limit wear over time of the dies used to forge the parts and facilitate stripping of the forged parts, it is essential to carry out regular lubrication of said dies or said parts, generally by spraying them with a suitable lubricant.

Over the years, the nature and composition of lubricants used in the field of forgery have evolved under the pressure of new constraints, in particular, environmental ones.

The first lubricants used for forging were made of fat. Then, from the 1950's to the 1970's, graphite oil based lubricants, that is to say, oil containing graphite, made their appearance. These relatively efficient lubricants are still used at the time of the present invention. However, their use generates large quantities of soot which poses a threat to both the environment and the health of the operator. On the other hand, these large quantities of soot increase the risk of fire.

Thereafter, graphite aqueous products based lubricants were developed. These lubricants also contain graphite and brought only a partial solution to the environmental issues and to the operators' health problems.

Finally, non-graphite aqueous products based lubricants, frequently referred to as "white products" were developed. These graphite-free "white products", are generally prepared by making one or more base(s) react in water, in particular, soda and/or potash, with one or more mono- or dicarboxylic acid(s) in particular adipic acid, isophthalic acid, sebacic acid and/or succinic acid. It is this mixture of acid(s) and base(s) which constitutes the lubricating agent.

These formulations come in the form of solutions containing the lubricating agent. They are less messy and more environment-friendly than graphite aqueous solutions based formulations.

However, these "white" formulations, less effective in reducing wear on forging dies than graphite formulations, must be applied more frequently on said dies than the graphite formulations. This increase in the frequency of applying the "white" products involves the use of a greater quantity of lubricating agent thus, forcing the end user to store larger quantities of lubricating solution.

Yet, the quantity of lubricating agent present in the "white" solutions is limited by the limit of solubility of the salt(s) obtained to prevent it from crystallizing and the solution from being no longer usable. The transport and storage of large quantities of lubricating agent thus implies the transport and storage of large volumes of "white" solutions, which is problematic both in terms of product transport (material difficulties and pollution) and in terms of end user (large storage volume).

In order to limit as much as possible the required storage volumes, the solutions are generally concentrated and hence can be applied on the forging dies only after having been previously diluted by the end user. This dilution for preparing the finally used lubricating solution is generally not easy.

German patent application DE 30 01 102 describes compositions for lubricating forges comprising different lubricant additives as well as possibly a sodium carbonate and citric acid, that is to say, a tricarboxylic acid, based "explosive" mixture. This patent application provides no details as to the molar ratio between sodium carbonate and tricarboxylic acid. On the other hand, the compositions described in this patent application contain, as lubricating agent, high proportions of carbon and/or molybdenum disulphide. Finally, the compositions described in this patent application cannot be implemented, as the "explosive" mixture and the water contained in the composition react together, preventing any compaction of the powder or conservation of the composition in an acceptable condition which would then allow the use thereof.

Thus, at the time of the present invention, there is a need for lubricating products for forging which are at least equivalent to the "white" products in terms of efficiency (in terms of lubrication) and environmental impact, but are easier to transport, store, and can be easily handled by the end user during their dilution or their use.

Yet, it has now been found a lubricating product which allows addressing effectively these issues.

Thus, the present invention relates to a lubricating composition for forging in the form of a powder or a compacted powder comprising:

- one or more dicarboxylic acid(s) chosen among adipic acid, phthalic acid, isophthalic acid, terephthalic acid, sebacic acid, succinic acid and suberic acid, and
- one or more base(s) chosen among sodium carbonate, sodium bicarbonate, potassium carbonate and potassium bicarbonate, The dicarboxylic acid(s)/base(s) molar ratio ranging between 0.8 and 1.2.

The lubricating composition according to the present invention allows to effectively solve the aforementioned issues. In fact, these compositions are water free and thereby much easier to transport and store than the conventionally used "white" products.

In addition, the composition according to the invention can be handled very easily by the user and the dosage of the lubricating solution is carried out by simply weighing the powder or granules, or by adding a determined number of compressed tablets, tablets or pebbles.

On the other hand, the composition according to the invention is effervescent thus allowing a good dissolution and a good diffusion of it without any stirring of the bath in which it is introduced when it is in the form of a compacted powder, or with gentle stirring when it is in the form of a powder.

Thus, in order to prepare the lubricating solution from the composition of the invention, the user only has to add the required quantity of said composition in order to obtain the desired dilution in an industrial or softened water bath, possibly with slight stirring according to the form of the used composition (that is to say, powder or compacted powder).

Finally, lubricating solutions prepared from the compositions according to the invention have an efficiency (in terms of lubrication) at least equivalent to "white" products.

Within the context of the present invention:

- the term "compacted powder" means any formulation prepared by compression of a powder, in particular, granules (or pellets), compressed tablets, tablets and pebbles
- "adipic acid" corresponds to the compound registered under number CAS 124-04-9, also referred to as 1,6-hexanedioic acid;
- "phthalic acid" corresponds to the compound registered under number CAS 88-99-3, also referred to as benzene-1,2-dicarboxylic acid;
- "isophthalic acid" corresponds to the compound registered under number CAS 121-91-5, also referred to as Benzene-1,3-dicarboxylic acid;
- "terephthalic acid" corresponds to the compound registered under number CAS 100-21-0, also referred to as Benzene-1,4-dicarboxylic acid or paraphthalic acid;
- "sebacic acid" corresponds to the compound registered under number CAS 111-20-6, also referred to as 1,8-octanedicarboxylic acid or decanedioic acid;
- "succinic acid" corresponds to the compound registered under number CAS 110-15-6, also referred to as 1,4-butanedioic acid;
- "suberic acid" corresponds to the compound registered under number CAS 505-48-6, also referred to as octanedioic acid;
- "sodium carbonate" or $Na_2CO_3$ corresponds to the compound registered under number CAS 497-19-8, also referred to as carbonate of soda;
- "sodium bicarbonate" or $NaHCO_3$ corresponds to the compound registered under number CAS 144-55-8, also referred to as sodium hydrogen carbonate, monosodium carbonate, sodium acid carbonate or bicarbonate of soda;
- "potassium carbonate" or $K_2CO_3$ corresponds to the compound registered under number CAS 584-08-7;
- "potassium bicarbonate" or $KHCO_3$ corresponds to the compound registered under number CAS 298-14-6 also referred to as potassium hydrogen carbonate or potassium acid carbonate; and
- unless otherwise specified, the proportions expressed in % correspond to mass percentages with respect to the total weight of the considered entity.

The lubricating composition according to the present invention comprises one or more dicarboxylic acid(s) and one or more base(s). Preferably, the present invention relates to a lubricating composition as defined previously having the following characteristics, selected alone or in combination:

- the composition comprises from 30% to 100% of the dicarboxylic acid(s) and base(s) association, preferably from 40% to 100% of the dicarboxylic acid(s) and base(s) association, preferably still from 50% to 100% of the dicarboxylic acid(s) and base(s) association, and most preferably from 60% to 100% of the dicarboxylic acid(s) and base(s) association;
- the dicarboxylic acid(s)/base(s) molar ratio ranges between 0.9 and 1.1. Most preferably, the dicarboxylic acid(s)/base(s) molar ratio is equal to 1.

The composition according to the present invention may contain graphite or be graphite-free.

By way of examples of the composition according to the present invention, it may be in particular cited lubricating compositions for forging in the form of a powder or a compacted powder comprising:

- adipic acid and sodium carbonate;
- adipic acid and sodium bicarbonate;
- adipic acid and potassium carbonate;
- adipic acid and potassium bicarbonate;
- adipic acid, sodium carbonate and sodium bicarbonate;
- adipic acid, sodium carbonate and potassium carbonate;
- adipic acid, sodium carbonate and potassium bicarbonate;
- adipic acid, sodium bicarbonate and potassium carbonate;
- adipic acid, sodium bicarbonate and potassium bicarbonate;
- adipic acid, potassium carbonate and potassium bicarbonate;
- phthalic acid and sodium carbonate;
- phthalic acid and sodium bicarbonate;
- phthalic acid and potassium carbonate;
- phthalic acid and potassium bicarbonate;
- phthalic acid, sodium carbonate and sodium bicarbonate;
- phthalic acid, sodium carbonate and potassium carbonate;
- phthalic acid, sodium carbonate and potassium bicarbonate;
- phthalic acid, sodium bicarbonate and potassium carbonate;
- phthalic acid, sodium bicarbonate and potassium bicarbonate;
- phthalic acid, potassium carbonate and potassium bicarbonate;
- isophthalic acid and sodium carbonate;
- isophthalic acid and sodium bicarbonate;
- isophthalic acid and potassium carbonate;
- isophthalic acid and potassium bicarbonate;
- isophthalic acid, sodium carbonate and sodium bicarbonate;
- isophthalic acid, sodium carbonate and potassium carbonate;
- isophthalic acid, sodium carbonate and potassium bicarbonate;
- isophthalic acid, sodium bicarbonate and potassium carbonate;
- isophthalic acid, sodium bicarbonate and potassium bicarbonate;
- isophthalic acid, potassium carbonate and potassium bicarbonate;
- terephthalic acid and sodium carbonate;
- terephthalic acid and sodium bicarbonate;
- terephthalic acid and potassium carbonate;
- terephthalic acid and potassium bicarbonate;
- terephthalic acid, sodium carbonate and sodium bicarbonate;
- terephthalic acid, sodium carbonate and potassium carbonate;
- terephthalic acid, sodium carbonate and potassium bicarbonate;
- terephthalic acid, sodium bicarbonate and potassium carbonate;
- terephthalic acid, sodium bicarbonate and potassium bicarbonate;

terephthalic acid, potassium carbonate and potassium bicarbonate;
sebacic acid and sodium carbonate;
sebacic acid and sodium bicarbonate;
sebacic acid and potassium carbonate;
sebacic acid and potassium bicarbonate;
sebacic acid, sodium carbonate and sodium bicarbonate;
sebacic acid, sodium carbonate and potassium carbonate;
sebacic acid, sodium carbonate and potassium bicarbonate;
sebacic acid, sodium bicarbonate and potassium carbonate;
sebacic acid, sodium bicarbonate and potassium bicarbonate;
sebacic acid, potassium carbonate and potassium bicarbonate;
succinic acid and sodium carbonate;
succinic acid and sodium bicarbonate;
succinic acid and potassium carbonate;
succinic acid and potassium bicarbonate;
succinic acid, sodium carbonate and sodium bicarbonate;
succinic acid, sodium carbonate and potassium carbonate;
succinic acid, sodium carbonate and potassium bicarbonate;
succinic acid, sodium bicarbonate and potassium carbonate;
succinic acid, sodium bicarbonate and potassium bicarbonate;
succinic acid, potassium carbonate and potassium bicarbonate;
suberic acid and sodium carbonate;
suberic acid and sodium bicarbonate;
suberic acid and potassium carbonate;
suberic acid and potassium bicarbonate;
suberic acid, sodium carbonate and sodium bicarbonate;
suberic acid, sodium carbonate and potassium carbonate;
suberic acid, sodium carbonate and potassium bicarbonate;
suberic acid, sodium bicarbonate and potassium carbonate;
suberic acid, sodium bicarbonate and potassium bicarbonate;
suberic acid, potassium carbonate and potassium bicarbonate;
adipic acid, phthalic acid and sodium carbonate;
adipic acid, phthalic acid and sodium bicarbonate;
adipic acid, phthalic acid and potassium carbonate;
adipic acid, phthalic acid and potassium bicarbonate;
adipic acid, phthalic acid, sodium carbonate and sodium bicarbonate;
adipic acid, phthalic acid, sodium carbonate and potassium carbonate;
adipic acid, phthalic acid, sodium carbonate and potassium bicarbonate;
adipic acid, phthalic acid, sodium bicarbonate and potassium carbonate;
adipic acid, phthalic acid, sodium bicarbonate and potassium bicarbonate;
adipic acid, phthalic acid, potassium carbonate and potassium bicarbonate;
adipic acid, isophthalic acid and sodium carbonate;
adipic acid, isophthalic acid and sodium bicarbonate;
adipic acid, isophthalic acid and potassium carbonate;
adipic acid, isophthalic acid and potassium bicarbonate;
adipic acid, isophthalic acid, sodium carbonate and sodium bicarbonate;
adipic acid, isophthalic acid, sodium carbonate and potassium carbonate;
adipic acid, isophthalic acid, sodium carbonate and potassium bicarbonate;
adipic acid, isophthalic acid, sodium bicarbonate and potassium carbonate;
adipic acid, isophthalic acid, sodium bicarbonate and potassium bicarbonate;
adipic acid, isophthalic acid, potassium carbonate and potassium bicarbonate;
adipic acid, terephthalic acid and sodium carbonate;
adipic acid, terephthalic acid and sodium bicarbonate;
adipic acid, terephthalic acid and potassium carbonate;
adipic acid, terephthalic acid and potassium bicarbonate;
adipic acid, terephthalic acid, sodium carbonate and sodium bicarbonate;
adipic acid, terephthalic acid, sodium carbonate and potassium carbonate;
adipic acid, terephthalic acid, sodium carbonate and potassium bicarbonate;
adipic acid, terephthalic acid, sodium bicarbonate and potassium carbonate;
adipic acid, terephthalic acid, sodium bicarbonate and potassium bicarbonate;
adipic acid, terephthalic acid, potassium carbonate and potassium bicarbonate;
adipic acid, sebacic acid and sodium carbonate;
adipic acid, sebacic acid and sodium bicarbonate;
adipic acid, sebacic acid and potassium carbonate;
adipic acid, sebacic acid and potassium bicarbonate;
adipic acid, sebacic acid, sodium carbonate and sodium bicarbonate;
adipic acid, sebacic acid, sodium carbonate and potassium carbonate;
adipic acid, sebacic acid, sodium carbonate and potassium bicarbonate;
adipic acid, sebacic acid, sodium bicarbonate and potassium carbonate;
adipic acid, sebacic acid, sodium bicarbonate and potassium bicarbonate;
adipic acid, sebacic acid, potassium carbonate and potassium bicarbonate;
adipic acid, succinic acid and sodium carbonate;
adipic acid, succinic acid and sodium bicarbonate;
adipic acid, succinic acid and potassium carbonate;
adipic acid, succinic acid and potassium bicarbonate;
adipic acid, succinic acid, sodium carbonate and sodium bicarbonate;
adipic acid, succinic acid, sodium carbonate and potassium carbonate;
adipic acid, succinic acid, sodium carbonate and potassium bicarbonate;
adipic acid, succinic acid, sodium bicarbonate and potassium carbonate;
adipic acid, succinic acid, sodium bicarbonate and potassium bicarbonate;
adipic acid, succinic acid, potassium carbonate and potassium bicarbonate;
adipic acid, suberic acid and sodium carbonate;
adipic acid, suberic acid and sodium bicarbonate;
adipic acid, suberic acid and potassium carbonate;
adipic acid, suberic acid and potassium bicarbonate;
adipic acid, suberic acid, sodium carbonate and sodium bicarbonate;
adipic acid, suberic acid, sodium carbonate and potassium carbonate;

adipic acid, suberic acid, sodium carbonate and potassium bicarbonate;
adipic acid, suberic acid, sodium bicarbonate and potassium carbonate;
adipic acid, suberic acid, sodium bicarbonate and potassium bicarbonate;
adipic acid, suberic acid, potassium carbonate and potassium bicarbonate;
phthalic acid, isophthalic acid and sodium carbonate;
phthalic acid, isophthalic acid and sodium bicarbonate;
phthalic acid, isophthalic acid and potassium carbonate;
phthalic acid, isophthalic acid and potassium bicarbonate;
phthalic acid, isophthalic acid, sodium carbonate and sodium bicarbonate;
phthalic acid, isophthalic acid, sodium carbonate and potassium carbonate;
phthalic acid, isophthalic acid, sodium carbonate and potassium bicarbonate;
phthalic acid, isophthalic acid, sodium bicarbonate and potassium carbonate;
phthalic acid, isophthalic acid, sodium bicarbonate and potassium bicarbonate;
phthalic acid, isophthalic acid, potassium carbonate and potassium bicarbonate;
phthalic acid, terephthalic acid and sodium carbonate;
phthalic acid, terephthalic acid and sodium bicarbonate;
phthalic acid, terephthalic acid and potassium carbonate;
phthalic acid, terephthalic acid and potassium bicarbonate;
phthalic acid, terephthalic acid, sodium carbonate and sodium bicarbonate;
phthalic acid, terephthalic acid, sodium carbonate and potassium carbonate;
phthalic acid, terephthalic acid, sodium carbonate and potassium bicarbonate;
phthalic acid, terephthalic acid, sodium bicarbonate and potassium carbonate;
phthalic acid, terephthalic acid, sodium bicarbonate and potassium bicarbonate;
phthalic acid, terephthalic acid, potassium carbonate and potassium bicarbonate;
phthalic acid, sebacic acid and sodium carbonate;
phthalic acid, sebacic acid and sodium bicarbonate;
phthalic acid, sebacic acid and potassium carbonate;
phthalic acid, sebacic acid and potassium bicarbonate;
phthalic acid, sebacic acid, sodium carbonate and sodium bicarbonate;
phthalic acid, sebacic acid, sodium carbonate and potassium carbonate;
phthalic acid, sebacic acid, sodium carbonate and potassium bicarbonate;
phthalic acid, sebacic acid, sodium bicarbonate and potassium carbonate;
phthalic acid, sebacic acid, sodium bicarbonate and potassium bicarbonate;
phthalic acid, sebacic acid, potassium carbonate and potassium bicarbonate;
phthalic acid, succinic acid and sodium carbonate;
phthalic acid, succinic acid and sodium bicarbonate;
phthalic acid, succinic acid and potassium carbonate;
phthalic acid, succinic acid and potassium bicarbonate;
phthalic acid, succinic acid, sodium carbonate and sodium bicarbonate;
phthalic acid, succinic acid, sodium carbonate and potassium carbonate;
phthalic acid, succinic acid, sodium carbonate and potassium bicarbonate;
phthalic acid, succinic acid, sodium bicarbonate and potassium carbonate;
phthalic acid, succinic acid, sodium bicarbonate and potassium bicarbonate;
phthalic acid, succinic acid, potassium carbonate and potassium bicarbonate;
phthalic acid, suberic acid and sodium carbonate;
phthalic acid, suberic acid and sodium bicarbonate;
phthalic acid, suberic acid and potassium carbonate;
phthalic acid, suberic acid and potassium bicarbonate;
phthalic acid, suberic acid, sodium carbonate and sodium bicarbonate;
phthalic acid, suberic acid, sodium carbonate and potassium carbonate;
phthalic acid, suberic acid, sodium carbonate and potassium bicarbonate;
phthalic acid, suberic acid, sodium bicarbonate and potassium carbonate;
phthalic acid, suberic acid, sodium bicarbonate and potassium bicarbonate;
phthalic acid, suberic acid, potassium carbonate and potassium bicarbonate;
isophthalic acid, terephthalic acid and sodium carbonate;
isophthalic acid, terephthalic acid and sodium bicarbonate;
isophthalic acid, terephthalic acid and potassium carbonate;
isophthalic acid, terephthalic acid and potassium bicarbonate;
isophthalic acid, terephthalic acid, sodium carbonate and sodium bicarbonate;
isophthalic acid, terephthalic acid, sodium carbonate and potassium carbonate;
isophthalic acid, terephthalic acid, sodium carbonate and potassium bicarbonate;
isophthalic acid, terephthalic acid, sodium bicarbonate and potassium carbonate;
isophthalic acid, terephthalic acid, sodium bicarbonate and potassium bicarbonate;
isophthalic acid, terephthalic acid, potassium carbonate and potassium bicarbonate;
isophthalic acid, sebacic acid and sodium carbonate;
isophthalic acid, sebacic acid and sodium bicarbonate;
isophthalic acid, sebacic acid and potassium carbonate;
isophthalic acid, sebacic acid and potassium bicarbonate;
isophthalic acid, sebacic acid, sodium carbonate and sodium bicarbonate;
isophthalic acid, sebacic acid, sodium carbonate and potassium carbonate;
isophthalic acid, sebacic acid, sodium carbonate and potassium bicarbonate;
isophthalic acid, sebacic acid, sodium bicarbonate and potassium carbonate;
isophthalic acid, sebacic acid, sodium bicarbonate and potassium bicarbonate;
isophthalic acid, sebacic acid, potassium carbonate and potassium bicarbonate;
isophthalic acid, succinic acid and sodium carbonate;
isophthalic acid, succinic acid and sodium bicarbonate;
isophthalic acid, succinic acid and potassium carbonate;
isophthalic acid, succinic acid and potassium bicarbonate;
isophthalic acid, succinic acid, sodium carbonate and sodium bicarbonate;
isophthalic acid, succinic acid, sodium carbonate and potassium carbonate;
isophthalic acid, succinic acid, sodium carbonate and potassium bicarbonate;

isophthalic acid, succinic acid, sodium bicarbonate and potassium carbonate;
isophthalic acid, succinic acid, sodium bicarbonate and potassium bicarbonate;
isophthalic acid, succinic acid, potassium carbonate and potassium bicarbonate;
isophthalic acid, suberic acid and sodium carbonate;
isophthalic acid, suberic acid and sodium bicarbonate;
isophthalic acid, suberic acid and potassium carbonate;
isophthalic acid, suberic acid and potassium bicarbonate;
isophthalic acid, suberic acid, sodium carbonate and sodium bicarbonate;
isophthalic acid, suberic acid, sodium carbonate and potassium carbonate;
isophthalic acid, suberic acid, sodium carbonate and potassium bicarbonate;
isophthalic acid, suberic acid, sodium bicarbonate and potassium carbonate;
isophthalic acid, suberic acid, sodium bicarbonate and potassium bicarbonate;
isophthalic acid, suberic acid, potassium carbonate and potassium bicarbonate;
sebacic acid, succinic acid and sodium carbonate;
sebacic acid, succinic acid and sodium bicarbonate;
sebacic acid, succinic acid and potassium carbonate;
sebacic acid, succinic acid and potassium bicarbonate;
sebacic acid, succinic acid, sodium carbonate and sodium bicarbonate;
sebacic acid, succinic acid, sodium carbonate and potassium carbonate;
sebacic acid, succinic acid, sodium carbonate and potassium bicarbonate;
sebacic acid, succinic acid, sodium bicarbonate and potassium carbonate;
sebacic acid, succinic acid, sodium bicarbonate and potassium bicarbonate;
sebacic acid, succinic acid, potassium carbonate and potassium bicarbonate;
sebacic acid, suberic acid and sodium carbonate;
sebacic acid, suberic acid and sodium bicarbonate;
sebacic acid, suberic acid and potassium carbonate;
sebacic acid, suberic acid and potassium bicarbonate;
sebacic acid, suberic acid, sodium carbonate and sodium bicarbonate;
sebacic acid, suberic acid, sodium carbonate and potassium carbonate;
sebacic acid, suberic acid, sodium carbonate and potassium bicarbonate;
sebacic acid, suberic acid, sodium bicarbonate and potassium carbonate;
sebacic acid, suberic acid, sodium bicarbonate and potassium bicarbonate;
sebacic acid, suberic acid, potassium carbonate and potassium bicarbonate;
succinic acid, suberic acid and sodium carbonate;
succinic acid, suberic acid and sodium bicarbonate;
succinic acid, suberic acid and potassium carbonate;
succinic acid, suberic acid and potassium bicarbonate;
succinic acid, suberic acid, sodium carbonate and sodium bicarbonate;
succinic acid, suberic acid, sodium carbonate and potassium carbonate;
succinic acid, suberic acid, sodium carbonate and potassium bicarbonate;
succinic acid, suberic acid, sodium bicarbonate and potassium carbonate;
succinic acid, suberic acid, sodium bicarbonate and potassium bicarbonate;
succinic acid, suberic acid, potassium carbonate and potassium bicarbonate;
adipic acid, phthalic acid, isophthalic acid and sodium carbonate;
adipic acid, phthalic acid, isophthalic acid and sodium bicarbonate;
adipic acid, phthalic acid, isophthalic acid and potassium carbonate;
adipic acid, phthalic acid, isophthalic acid and potassium bicarbonate;
adipic acid, phthalic acid, isophthalic acid, sodium carbonate and sodium bicarbonate;
adipic acid, phthalic acid, isophthalic acid, sodium carbonate and potassium carbonate;
adipic acid, phthalic acid, isophthalic acid, sodium carbonate and potassium bicarbonate;
adipic acid, phthalic acid, isophthalic acid, sodium bicarbonate and potassium carbonate;
adipic acid, phthalic acid, isophthalic acid, sodium bicarbonate and potassium bicarbonate;
adipic acid, phthalic acid, isophthalic acid, potassium carbonate and potassium bicarbonate;
adipic acid, phthalic acid, terephthalic acid and sodium carbonate;
adipic acid, phthalic acid, terephthalic acid and sodium bicarbonate;
adipic acid, phthalic acid, terephthalic acid and potassium carbonate; adipic acid, phthalic acid, terephthalic acid and potassium bicarbonate;
adipic acid, phthalic acid, terephthalic acid, sodium carbonate and sodium bicarbonate;
adipic acid, phthalic acid, terephthalic acid, sodium carbonate and potassium carbonate;
adipic acid, phthalic acid, terephthalic acid, sodium carbonate and potassium bicarbonate;
adipic acid, phthalic acid, terephthalic acid, sodium bicarbonate and potassium carbonate;
adipic acid, phthalic acid, terephthalic acid, sodium bicarbonate and potassium bicarbonate;
adipic acid, phthalic acid, terephthalic acid, potassium carbonate and potassium bicarbonate;
adipic acid, phthalic acid, sebacic acid and sodium carbonate;
adipic acid, phthalic acid, sebacic acid and sodium bicarbonate;
adipic acid, phthalic acid, sebacic acid and potassium carbonate;
adipic acid, phthalic acid, sebacic acid and potassium bicarbonate;
adipic acid, phthalic acid, sebacic acid, sodium carbonate and sodium bicarbonate;
adipic acid, phthalic acid, sebacic acid, sodium carbonate and potassium carbonate;
adipic acid, phthalic acid, sebacic acid, sodium carbonate and potassium bicarbonate;
adipic acid, phthalic acid, sebacic acid, sodium bicarbonate and potassium carbonate;
adipic acid, phthalic acid, sebacic acid, sodium bicarbonate and potassium bicarbonate;
adipic acid, phthalic acid, sebacic acid, potassium carbonate and potassium bicarbonate;
adipic acid, phthalic acid, succinic acid and sodium carbonate;
adipic acid, phthalic acid, succinic acid and sodium bicarbonate;

adipic acid, phthalic acid, succinic acid and potassium carbonate;
adipic acid, phthalic acid, succinic acid and potassium bicarbonate;
adipic acid, phthalic acid, succinic acid, sodium carbonate and sodium bicarbonate;
adipic acid, phthalic acid, succinic acid, sodium carbonate and potassium carbonate;
adipic acid, phthalic acid, succinic acid, sodium carbonate and potassium bicarbonate;
adipic acid, phthalic acid, succinic acid, sodium bicarbonate and potassium carbonate;
adipic acid, phthalic acid, succinic acid, sodium bicarbonate and potassium bicarbonate;
adipic acid, phthalic acid, succinic acid, potassium carbonate and potassium bicarbonate;
adipic acid, phthalic acid, suberic acid and sodium carbonate;
adipic acid, phthalic acid, suberic acid and sodium bicarbonate;
adipic acid, phthalic acid, suberic acid and potassium carbonate;
adipic acid, phthalic acid, suberic acid and potassium bicarbonate;
adipic acid, phthalic acid, suberic acid, sodium carbonate and sodium bicarbonate;
adipic acid, phthalic acid, suberic acid, sodium carbonate and potassium carbonate;
adipic acid, phthalic acid, suberic acid, sodium carbonate and potassium bicarbonate;
adipic acid, phthalic acid, suberic acid, sodium bicarbonate and potassium carbonate;
adipic acid, phthalic acid, suberic acid, sodium bicarbonate and potassium bicarbonate;
adipic acid, phthalic acid, suberic acid, potassium carbonate and potassium bicarbonate;
phthalic acid, isophthalic acid, terephthalic acid and sodium carbonate;
phthalic acid, isophthalic acid, terephthalic acid and sodium bicarbonate;
phthalic acid, isophthalic acid, terephthalic acid and potassium carbonate;
phthalic acid, isophthalic acid, terephthalic acid and potassium bicarbonate;
phthalic acid, isophthalic acid, terephthalic acid, sodium carbonate and sodium bicarbonate;
phthalic acid, isophthalic acid, terephthalic acid, sodium carbonate and potassium carbonate;
phthalic acid, isophthalic acid, terephthalic acid, sodium carbonate and potassium bicarbonate;
phthalic acid, isophthalic acid, terephthalic acid, sodium bicarbonate and potassium carbonate;
phthalic acid, isophthalic acid, terephthalic acid, sodium bicarbonate and potassium bicarbonate;
phthalic acid, isophthalic acid, terephthalic acid, potassium carbonate and potassium bicarbonate;
phthalic acid, isophthalic acid, sebacic acid and sodium carbonate;
phthalic acid, isophthalic acid, sebacic acid and sodium bicarbonate;
phthalic acid, isophthalic acid, sebacic acid and potassium carbonate;
phthalic acid, isophthalic acid, sebacic acid and potassium bicarbonate;
phthalic acid, isophthalic acid, sebacic acid, sodium carbonate and sodium bicarbonate;
phthalic acid, isophthalic acid, sebacic acid, sodium carbonate and potassium carbonate;
phthalic acid, isophthalic acid, sebacic acid, sodium carbonate and potassium bicarbonate;
phthalic acid, isophthalic acid, sebacic acid, sodium bicarbonate and potassium carbonate;
phthalic acid, isophthalic acid, sebacic acid, sodium bicarbonate and potassium bicarbonate;
phthalic acid, isophthalic acid, sebacic acid, potassium carbonate and potassium bicarbonate;
phthalic acid, isophthalic acid, succinic acid and sodium carbonate;
phthalic acid, isophthalic acid, succinic acid and sodium bicarbonate;
phthalic acid, isophthalic acid, succinic acid and potassium carbonate;
phthalic acid, isophthalic acid, succinic acid and potassium bicarbonate;
phthalic acid, isophthalic acid, succinic acid, sodium carbonate and sodium bicarbonate;
phthalic acid, isophthalic acid, succinic acid, sodium carbonate and potassium carbonate;
phthalic acid, isophthalic acid, succinic acid, sodium carbonate and potassium bicarbonate;
phthalic acid, isophthalic acid, succinic acid, sodium bicarbonate and potassium carbonate;
phthalic acid, isophthalic acid, succinic acid, sodium bicarbonate and potassium bicarbonate;
phthalic acid, isophthalic acid, succinic acid, potassium carbonate and potassium bicarbonate;
phthalic acid, isophthalic acid, suberic acid and sodium carbonate;
phthalic acid, isophthalic acid, suberic acid and sodium bicarbonate;
phthalic acid, isophthalic acid, suberic acid and potassium carbonate;
phthalic acid, isophthalic acid, suberic acid and potassium bicarbonate;
phthalic acid, isophthalic acid, suberic acid, sodium carbonate and sodium bicarbonate;
phthalic acid, isophthalic acid, suberic acid, sodium carbonate and potassium carbonate;
phthalic acid, isophthalic acid, suberic acid, sodium carbonate and potassium bicarbonate;
phthalic acid, isophthalic acid, suberic acid, sodium bicarbonate and potassium carbonate;
phthalic acid, isophthalic acid, suberic acid, sodium bicarbonate and potassium bicarbonate;
phthalic acid, isophthalic acid, suberic acid, potassium carbonate and potassium bicarbonate;
isophthalic acid, terephthalic acid, sebacic acid and sodium carbonate;
isophthalic acid, terephthalic acid, sebacic acid and sodium bicarbonate;
isophthalic acid, terephthalic acid, sebacic acid and potassium carbonate;
isophthalic acid, terephthalic acid, sebacic acid and potassium bicarbonate;
isophthalic acid, terephthalic acid, sebacic acid, sodium carbonate and sodium bicarbonate;
isophthalic acid, terephthalic acid, sebacic acid, sodium carbonate and potassium carbonate;
isophthalic acid, terephthalic acid, sebacic acid, sodium carbonate and potassium bicarbonate;
isophthalic acid, terephthalic acid, sebacic acid, sodium bicarbonate and potassium carbonate;

isophthalic acid, terephthalic acid, sebacic acid, sodium bicarbonate and potassium bicarbonate;
isophthalic acid, terephthalic acid, sebacic acid, potassium carbonate and potassium bicarbonate;
isophthalic acid, terephthalic acid, succinic acid and sodium carbonate;
isophthalic acid, terephthalic acid, succinic acid and sodium bicarbonate;
isophthalic acid, terephthalic acid, succinic acid and potassium carbonate;
isophthalic acid, terephthalic acid, succinic acid and potassium bicarbonate;
isophthalic acid, terephthalic acid, succinic acid, sodium carbonate and sodium bicarbonate;
isophthalic acid, terephthalic acid, succinic acid, sodium carbonate and potassium carbonate;
isophthalic acid, terephthalic acid, succinic acid, sodium carbonate and potassium bicarbonate;
isophthalic acid, terephthalic acid, succinic acid, sodium bicarbonate and potassium carbonate;
isophthalic acid, terephthalic acid, succinic acid, sodium bicarbonate and potassium bicarbonate;
isophthalic acid, terephthalic acid, succinic acid, potassium carbonate and potassium bicarbonate;
isophthalic acid, terephthalic acid, suberic acid and sodium carbonate;
isophthalic acid, terephthalic acid, suberic acid and sodium bicarbonate;
isophthalic acid, terephthalic acid, suberic acid and potassium carbonate;
isophthalic acid, terephthalic acid, suberic acid and potassium bicarbonate;
isophthalic acid, terephthalic acid, suberic acid, sodium carbonate and sodium bicarbonate;
isophthalic acid, terephthalic acid, suberic acid, sodium carbonate and potassium carbonate;
isophthalic acid, terephthalic acid, suberic acid, sodium carbonate and potassium bicarbonate;
isophthalic acid, terephthalic acid, suberic acid, sodium bicarbonate and potassium carbonate;
isophthalic acid, terephthalic acid, suberic acid, sodium bicarbonate and potassium bicarbonate;
isophthalic acid, terephthalic acid, suberic acid, potassium carbonate and potassium bicarbonate;
terephthalic acid, sebacic acid, succinic acid and sodium carbonate;
terephthalic acid, sebacic acid, succinic acid and sodium bicarbonate;
terephthalic acid, sebacic acid, succinic acid and potassium carbonate;
terephthalic acid, sebacic acid, succinic acid and potassium bicarbonate;
terephthalic acid, sebacic acid, succinic acid, sodium carbonate and sodium bicarbonate;
terephthalic acid, sebacic acid, succinic acid, sodium carbonate and potassium carbonate;
terephthalic acid, sebacic acid, succinic acid, sodium carbonate and potassium bicarbonate;
terephthalic acid, sebacic acid, succinic acid, sodium bicarbonate and potassium carbonate;
terephthalic acid, sebacic acid, succinic acid, sodium bicarbonate and potassium bicarbonate;
terephthalic acid, sebacic acid, succinic acid, potassium carbonate and potassium bicarbonate;
terephthalic acid, sebacic acid, suberic acid and sodium carbonate;
terephthalic acid, sebacic acid, suberic acid and sodium bicarbonate;
terephthalic acid, sebacic acid, suberic acid and potassium carbonate;
terephthalic acid, sebacic acid, suberic acid and potassium bicarbonate;
terephthalic acid, sebacic acid, suberic acid, sodium carbonate and sodium bicarbonate;
terephthalic acid, sebacic acid, suberic acid, sodium carbonate and potassium carbonate;
terephthalic acid, sebacic acid, suberic acid, sodium carbonate and potassium bicarbonate;
terephthalic acid, sebacic acid, suberic acid, sodium bicarbonate and potassium carbonate;
terephthalic acid, sebacic acid, suberic acid, sodium bicarbonate and potassium bicarbonate;
terephthalic acid, sebacic acid, suberic acid, potassium carbonate and potassium bicarbonate;
sebacic acid, succinic acid, suberic acid and sodium carbonate;
sebacic acid, succinic acid, suberic acid and sodium bicarbonate;
sebacic acid, succinic acid, suberic acid and potassium carbonate;
sebacic acid, succinic acid, suberic acid and potassium bicarbonate;
sebacic acid, succinic acid, suberic acid, sodium carbonate and sodium bicarbonate;
sebacic acid, succinic acid, suberic acid, sodium carbonate and potassium carbonate;
sebacic acid, succinic acid, suberic acid, sodium carbonate and potassium bicarbonate;
sebacic acid, succinic acid, suberic acid, sodium bicarbonate and potassium carbonate;
sebacic acid, succinic acid, suberic acid, sodium bicarbonate and potassium bicarbonate; or
sebacic acid, succinic acid, suberic acid, potassium carbonate and potassium bicarbonate.

By way of preferred examples of the composition according to the present invention, it may be cited lubricating compositions for forging in the form of a powder or a compacted powder comprising:

adipic acid and sodium carbonate;
adipic acid, sodium carbonate and potassium carbonate; or
adipic acid, isophthalic acid and sodium carbonate.

The lubricating compositions according to the invention may also contain, in addition to the aforementioned dicarboxylic acid(s) and to the base(s), any additive which is commonly used by the one skilled in the art for this type of composition. Thus, the present invention also relates to a lubricating composition for forging as defined previously, comprising, in addition to the dicarboxylic acid(s) and to the base(s), one or more additive(s) chosen among colorants, gelling or thickening agents, wetting and/or spreading agents, mineral fillers or binding agents, fillers or lubricant additives or extreme pressure or anti-wear.

The lubricating composition according to the present invention may contain from 0% to 2% of coloring agent. The coloring agents allow distinguishing between powders and compacted powders prior to their dilution and revealing the presence of the composition according to the invention in water. By way of examples of coloring agent usable within the context of the present invention, it may be in particular cited fluorescein, cationic dyes of the xanthene class (CAS 81-88-9), cationic dyes of the triphenylmethane class (CAS 3844-45-9) and E102 yellow tartrazine or E132 indigo carmine food dyes.

The lubricating composition according to the present invention may also contain from 0% to 10% of gelling or thickening agent. Gelling or thickening agents allow giving the composition of the invention the required consistency once in water and dispersing the insoluble fillers. As examples of gelling or thickening agent usable within the context of the present invention, it can be in particular cited derivatives of cellulose, xanthan gum, guar gum, arabic gum, silicates, clay and organic resin in particular of acrylic type.

The lubricating composition according to the present invention may also contain from 0% to 5% wetting and/or spreading agent. Wetting and/or spreading agents allow reducing the surface tension of the mixture and allow a uniform distribution of the lubricant on hot surfaces. An example of wetting and/or spreading agent usable within the context of the present invention, it may be in particular cited sodium sulfosuccinate.

The lubricating composition according to the present invention may also contain from 0% to 20% of mineral fillers or binding agents. Mineral fillers or binding agents allow the mechanical and thermal behavior of the film on the forging dies. As examples of mineral fillers or binding agents usable within the context of the present invention, it may be in particular cited phosphates, silicates, sulfates and organic polymers of polyolefin type.

The lubricating composition according to the present invention may also contain from 0% to 20% of fillers or lubricant additives or extreme pressure or anti-wear. Fillers or lubricant additives or extreme pressure or anti-wear allow reducing the friction coefficient or decreasing the wear of the dies. As examples of lubricating filler or extreme pressure or anti-wear usable within the context of the present invention, it may be in particular cited phosphates, sulfates, zinc dithiophosphate, organic polymers of polyolefin type or lubricants with lamellar structure such as graphite, boron nitride and molybdenum disulfide.

The lubricating composition according to the present invention may be in the form of a powder or a compacted powder. Preferably, the present invention relates to a lubricating composition for forging as previously defined in the form of a compacted powder, in particular in the form of tablets or pebbles. Most preferably, the present invention is in the form of pebbles. The pebbles may have a cylindrical shape having a diameter ranging from 10 to 300 mm, preferably from 30 to 60 mm; a height ranging from 10 to 100 mm, preferably from 15 to 40 mm; for a total weight ranging from 10 to 1.000 g, preferably from 30 to 70 g.

When it is in the form of a compacted powder, the composition according to the present invention may be introduced without any stirring in the industrial or softened water bath with a view to preparing the lubricating solution which will be finally used.

The effervescent property of the composition according to the invention allows it to dissolve and diffuse perfectly in the industrial or softened water bath with any stirring being required.

On the other hand, when the lubricating composition according to the invention is in the form of a compacted powder, the addition of one or more additional additive(s) known by the one skilled in the art may prove to be necessary. Thus, the present invention also relates to a lubricating composition for forging as previously defined, also comprising one or more additive(s) chosen among cohesion agents, disintegrant or bursting or crumbling agents and tableting aid agents.

The lubricating composition according to the present invention may also contain from 0% to 5% of cohesion agent. Cohesion agents allow the reinforcement of the cohesion of the compacted powder. As examples of cohesion agents usable within the context of the present invention, it may be in particular cited polyethylene glycol of molecular weight greater than 1000, the derivatives of polyvinylpyrrolidone and derivatives of methylcellulose.

The lubricating composition according to the present invention may also contain from 0% to 10% of disintegrant or bursting or crumbling agent. Disintegrant or bursting or crumbling agents promote a rapid dissolution of the compositions in the form of a compacted powder. As examples of disintegrant or bursting or crumbling agent usable within the context of the present invention, it may be in particular cited the amorphous or crystalline cellulose derivatives, carboxymethyl cellulose derivatives, cross-linked polyvinylpyrrolidone derivatives and acrylic acid polymers.

The lubricating composition according to the present invention may also contain from 0% to 2% of tableting aid agent. Tableting aid agents promote the ejection of the composition of the punch. Such as for example the tableting aid agent usable within the context of the present invention, it may be in particular cited bentonite.

The lubricating composition according to the present invention can be prepared according to any method known by the one skilled in the art for preparing this type of composition. By way of example, it may be in particular cited a method for preparing a lubricating composition for forging as defined previously, comprising the following steps mixing the powders;

optionally followed by a step of compacting the mixture.

The mixture of powders can be carried out in any powder mixer commonly used by the one skilled in the art.

The compacting of the thus obtained powder mixture may be carried out according to any method conventionally used by the one skilled in the art. By way of example it can be in particular cited the compaction method described in patent application FR 2946916.

The lubricating composition according to the present invention may hence be used to prepare a lubricating solution which will be applied on the forging dies. Thus, the present invention also relates to a method for preparing a lubricating solution for forging comprising the putting into solution of a lubricating composition as previously defined in an industrial or softened water bath, possibly under stirring. The dosage of the lubricating solution is done by simply weighing the powder or granules or by adding a determined number of compressed tablets, tablets or pebbles.

The lubricating solution prepared from the lubricating composition according to the present invention can be applied on the forging dies by any method or by any means known by the one skilled in the art. In particular, the lubricating solution prepared from the lubricating composition according to the present invention can be applied by automatic or manual spraying.

The present invention is illustrated in a non-limiting manner by the following examples.

EXAMPLE 1

Composition Comprising Adipic Acid and Sodium Carbonate

A mixture of which the composition is given in table 1 below is prepared.

TABLE 1

| Component | % (in weight) |
|---|---|
| Adipic acid | 57.032 |
| Sodium carbonate | 41.468 |
| PEG 1500 | 1.500 |

This formulation is obtained by adding the various components in a horizontal drum mixer, then by mixing for 10 minutes in order to obtain a homogeneous powder.

The powder is then compacted using a rotary punch press (LINOTECH Titan AG3).

The punches used for this operation are cylindrical punches with a diameter equal to 45 mm.

50 grams of powder are introduced into the compaction chambers.

The pressure applied to the powder to give it its lozenge shape is in the range of 120 kN for 16 $cm^2$ namely 75 MPa.

The obtained height of the lozenge is of 23 mm.

In order to prepare the lubricating solution, the user only has to prepare a bath of about 99 liters of softened water and add 61 lozenges (that is to say, 3.050 kg of composition). The bath does not need to be stirred, the lozenges dissolve with an effervescence promoting thus the mixture. The time of dilution is from about 40 to 45 minutes.

The obtained solution is then sprayed on the dies for die-stamping operations of copper parts.

The lubricating power of this solution is compared to that of a conventionally used solution (ORAFOR 62 from the company Condat in a 7% dilution) applied under identical conditions.

No difference in terms of lubrication has been found between the solution prepared from the lozenges according to the invention and the conventionally used lubricating solution.

EXAMPLE 2

Composition Comprising Adipic and Isophthalic Acid and Sodium Carbonate

A mixture of which the composition is given in table 2 below is prepared.

TABLE 2

| Component | % (in weight) |
|---|---|
| Adipic acid | 11.722 |
| Isophthalic acid | 47.674 |
| Sodium carbonate | 39.105 |
| PEG 1500 | 1.499 |

This formulation is obtained by adding the various components in a horizontal drum mixer, then by mixing for 10 minutes in order to obtain a homogeneous powder.

The powder is then compacted using a rotary punch press (LINOTECH Titan AG3).

The punches used for this operation are cylindrical punches with a diameter equal to 45 mm.

50 grams of powder are introduced into the compaction chambers.

The pressure applied on the powder to give its lozenge shape is in the range of 120 kN for 16 $cm^2$ namely 75 MPa.

The height of the obtained lozenge is 23 mm.

In order to prepare the lubricating solution, the user only has to prepare a bath of about 99 liters of softened water and to add 61 lozenges (that is to say, 3.050 kg of composition). The bath does not have to be stirred, the lozenges dissolve with an effervescence promoting thus the mixture. The time of dilution is about 40 minutes.

The obtained solution is then sprayed onto the dies for the die-stamping operations of the copper parts.

The lubricating power of this solution is compared to that of a conventionally used solution (ORAFOR K from the company Condat in a 9% dilution) applied under identical conditions.

No difference in terms of lubrication has been found between the solution prepared from the lozenges according to the invention and the conventionally used lubricating solution.

The invention claimed is:

1. A lubricating composition for forging in the form of a powder or a compacted powder comprising:

one or more dicarboxylic acid(s) chosen among adipic acid, phthalic acid, isophthalic acid, terephthalic acid, sebacic acid, succinic acid and suberic acid, and one or more base(s) chosen among sodium carbonate, sodium bicarbonate, potassium carbonate and potassium bicarbonate, the dicarboxylic acid(s)/base(s) molar ratio ranging between 0.8 and 1.2.

2. The composition according to claim 1, wherein the composition comprises from 30% to 100% by mass of the total composition of the combination of the dicarboxylic acid(s) and the base(s).

3. The composition according to claim 1, wherein the carboxylic acid(s) comprises adipic acid and the base(s) comprises sodium carbonate.

4. The composition according to claim 1, wherein the carboxylic acid(s) comprise adipic acid, and the base(s) comprise sodium carbonate and potassium carbonate.

5. The composition according to claim 1, wherein the carboxylic acid(s) comprise adipic acid and isophthalic acid and the base(s) comprises sodium carbonate.

6. The composition according to claim 1, further comprising one or more additive(s) chosen among colorants, gelling or thickening agents, wetting and/or spreading agents, mineral fillers or binding agents, and fillers or lubricant additives or extreme pressure or anti-wear.

7. The composition according to claim 1 is in the form of a compacted powder.

8. The composition according to claim 7, further comprising one or more additive(s) chosen among cohesion agents, disintegrating agents, and tableting aid agents.

9. A method for preparing a lubricating solution for forging comprising the putting into solution of a composition according to claim 1 in an industrial or softened water bath, possibly under stirring.

* * * * *